United States Patent [19]

Degrauwe et al.

[11] Patent Number: 4,672,304

[45] Date of Patent: Jun. 9, 1987

[54] REFERENCE VOLTAGE SOURCE

[75] Inventors: Marc Degrauwe, Boudry; Eric A. Vittoz, Cernier, both of Switzerland

[73] Assignee: Centre Electronique Horloger S.A., Switzerland

[21] Appl. No.: 818,748

[22] Filed: Jan. 14, 1986

[30] Foreign Application Priority Data

Jan. 17, 1985 [CH] Switzerland ..... 203/85

[51] Int. Cl.[4] ..... G05F 3/16

[52] U.S. Cl. ..... 323/314; 323/316

[58] Field of Search ..... 323/313, 314, 316

[56] References Cited

FOREIGN PATENT DOCUMENTS 0093086 4/1983 European Pat. Off. .

OTHER PUBLICATIONS

R. Ye et al., Bandgap Voltage Reference Sources in CMOS Technology, Electronics Letters, Jan. 7, 1982, vol. 18, No. 1.

Bang-Sup Song, et al., A Precision Curvature-Compensated CMOS Bandgap Reference, IEEE Journal of Solid-State Circuits, vol. SC-18, No. 6, Dec. 1983.

Carl R. Palmer et al., A Curvature Corrected Micropower Volteage Reference, ISSCC 81/Wednesday, Feb. 18, 1981/Ballrooms C-D/4:15 P.M.

Eric A. Vittoz, MOS Transistors Operated in the Lateral Bipolar Mode and Their Aplication in CMOS Technology, IEEE Journal of Solid-State Circuits, vol. SC-18, No. 3, Jun. 1983.

*Primary Examiner*—Patrick R. Salce

*Assistant Examiner*—Jeffrey Sterrett

*Attorney, Agent, or Firm*—Parkhurst & Oliff

[57] ABSTRACT

The present invention relates to a reference voltage source in CMOS technology. The reference voltage source is based on the use of two compatible bipolar transistors (T1) and (T2) working at different current densities. A transresistance amplifier (1) connected as a negative feedback between the collectors and bases of (T1) and (T2) delivers the reference voltage ($V_{ref}$). A conductor block (4) allows sufficient current to be drawn through the resistors (2) and (3) to render neglible the base current of (T1).

9 Claims, 8 Drawing Figures

REFERENCE VOLTAGE SOURCE

TECHNICAL FIELD

The present invention pertains to circuits able to serve as reference voltage sources and more particularly voltage sources making reference to the band-gap and compatible with MOS technologies.

BACKGROUND

The present development of electronic circuits shows a growing tendency to effect digital functions and analog functions on the same circuit. Although bipolar technologies are proving more attractive for purely analog circuits, MOS technologies have the advantage when the digital part of the circuit is important. Among the latter, complementary MOS (or CMOS) technology offers, in addition to the advantage of a high integration density, the possibility of very low power consumption.

Most circuits comprising an analog part require the construction of a block delivering a reference voltage. Such blocks have already been proposed in CMOS technology and are most often derived from circuits known in bipolar technology by the name of band-gap voltage references. These circuits use a pair of transistors working at different current densities and which, while having a bipolar functioning characteristic, are compatible with CMOS technology. Such transistors, also known as substrate transistors, always have their collectors connected to the substrate, which limits their application especially when the user wishes to adapt circuits which have been developed in bipolar technology.

An example of a circuit using such transistors can be found in the article by R. Ye and Y. Tsividis entitled "Bandgap voltage reference sources in CMOS technology," which appears in Electronics Letters of 7th Jan. 1982, Vol. 18, No. 1. The reference voltage is obtained by effecting a linear combination of the base-emitter voltages of substrate transistors in such a way as to compensate the effects of temperature. This linear combination is achieved by means of an operational amplifier and resistors. When the operational amplifier is constructed with the help of MOS transistors it presents a large input offset voltage which, not being proportional to the absolute temperature, cannot be easily compensated. This offset voltage results in an imprecision of the reference voltage value of the order of 50 millivolts. The article by Bang-Sup Song and Paul R. Gray entitled "A precision curvature-compensated CMOS bandgap reference," which appears in the IEEE Journal of Solid-State Circuits, Vol. SC-18, No. 6, December 1983, shows how this offset voltage can be compensated by means of switched capacitor circuit techniques. However, the precision of the output reference voltage remains limited by the phenomena of charge injection produced by the transistors functioning as switches.

A new type of MOS transistor, which exhibits a bipolar functioning characteristic without having the limitations of substrate transistors, is described in European Patent Application No. 0093086, filed by the present applicant on 22nd Apr. 1983. This new type of transistor, which will subsequently be referred to as a compatible bipolar transistor, has already been used in creating a voltage reference source, as it would appear from FIG. 20 of the article by E. Vittoz which appears in the IEEE Journal of Solid-State Circuits, Vol. SC-18, June 1983 and which is entitled "MOS transistors operated in the lateral bipolar mode and their application in CMOS technology." The disadvantage of the circuit described in the aforesaid article resides in the fact that it does not take into account the finite current gain value of compatible bipolar transistors, nor its dependence on temperature. Another disadvantage of this circuit is the high output impedance value, which prevents a current from being drawn, especially to supply other circuits, without the reference voltage value being distorted.

SUMMARY OF THE INVENTION

Therefore, one object of the present invention is the construction of a circuit which can serve as a reference voltage source and which does not exhibit the disadvantages mentioned above.

Another object of the invention is the development of a reference voltage source which is compatible with MOS technology and which uses compatible bipolar transistors.

A further object of the invention is to create a reference voltage source whose dependence on temperature can be easily compensated.

An additional object of the invention is to create a reference voltage source which presents a low output impedance.

One of the main advantages of the voltage reference circuit according to the invention is the precision of the reference voltage which is distinctly superior to that of known CMOS technology circuits. Furthermore, the circuit according to the invention has the ability to allow the adjustment of its temperature coefficient by adjusting the circuit to a given temperature while, for known CMOS technology circuits, there is no correlation between the two effects.

Further objects, characteristics and advantages of the present invention will be seen more clearly from reading the following description of particular embodiments, the description being made on a purely illustrative basis and with regard to the attached drawings:

Figure 1:
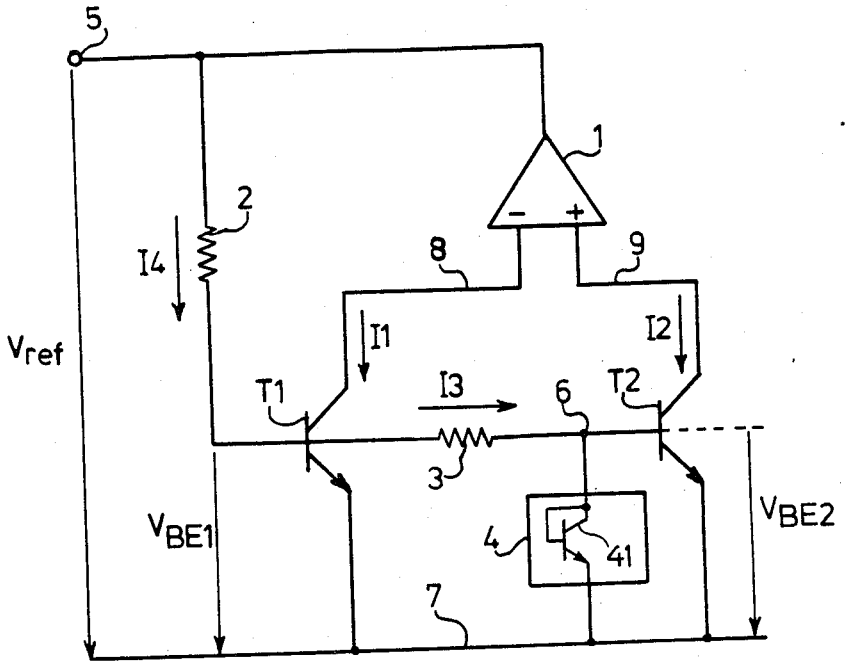
FIG. 1 is the principle layout of the circuit according to the invention.

The layout of FIG. 1 shows the principle of the invention. Two compatible bipolar transistors, such as are described in the aforesaid patent application, work at different current densities. The bases are connected through resistor 3, and the emitters are connected to the circuit's negative supply terminal 7. The currents 11 and 12 run through the collectors of T1 and T2 respectively, which collectors are connected to the inputs 8 and 9, respectively the inverting input and the non-inverting input, of a transresistance amplifier 1. The output of the amplifier 1 is connected to the output terminal 5 and to the base of the transistor T1 via the resistor 2. The base of the transistor T2 is linked to the terminal 7 through a conductor block 4 intended to draw through the resistor 3 a current 13 which is very large compared with the currents 11 and 12.

Figure 2:
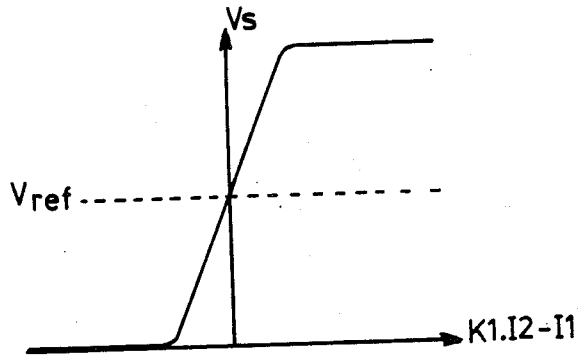
FIG. 2 is a curve characteristic of the amplifier of FIG. 1.

The characteristic transfer function of the amplifier 1 is given in FIG. 2 where $V_S$ represents the output voltage of the amplifier and K1 is the ratio of the gain of input 9 to that of input 8. If the value of the current 11 is slightly greater than I1.12, the output voltage of the amplifier 1 becomes very low, and if the value of the current 11 is slightly lower than I1.12, the output voltage of the amplifier 1 becomes very high.

When the amplifier 1 is connected as a negative feedback in the layout of FIG. 1, it sets the equation $I1=K1 \cdot I2$ where the output voltage $V_S$ existing at the terminal 5 is equal to:

$$V_{ref}=V_{BE1}+(R2/R1)\cdot(kT/q)\ln(K1\cdot K2) \quad (1)$$

In the above expression (1) of $V_{ref}$, $V_{BE1}$ is the base-emitter voltage of T1, R2 and R1 are the values of the resistors 2 and 3 respectively, k is Boltzmann's constant, T is the absolute temperature, q is the elementary electron charge, K1 has the value defined above and K2 is the ratio of the effective emitter surfaces of transistor T2 to transistor T1.

As has previously been mentioned, the two compatible bipolar transistors T1 and T2 have to work at different current densities; the density passing through transistor T2 must be lower than that passing through transistor T1. To ensure this difference between the current densities it is possible either to construct the transistors T1 and T2 with different geometries (in practice several identical transistors are arranged in parallel), or to construct the amplifier 1 in such a way that the gains of inputs 8 and 9 are in a given ratio (K1). In the first case the currents 11 and 12 may be equal, whilst in the second case they will be in the ratio K1.

The transistors T1 and T2 are compatible bipolar transistors as described in the aforementioned patent application. Such transistors present an ill-defined current gain which is difficult to reproduce from one integration to another. For the equation (1) to be satisfied despite the use of compatible bipolar transistors, it is necessary for the value of the current 13, drawn by the block 4 through the resistors 3, to be large in relation to that of the current 11.

Figure 3:
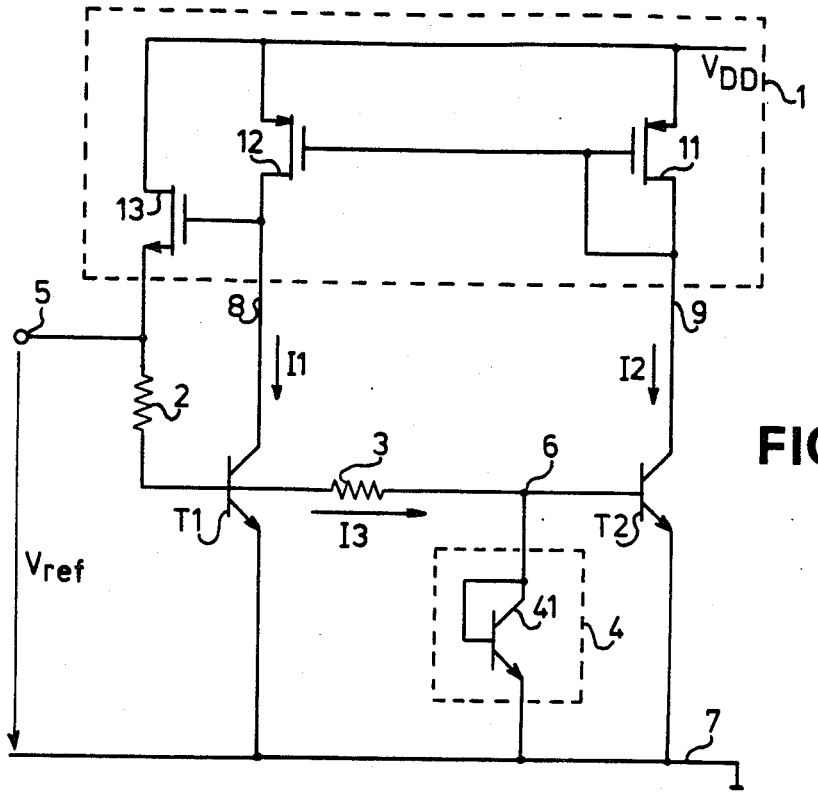
FIG. 3 is a first embodiment of the circuit of FIG. 1.

A first embodiment is shown in FIG. 3, in which the elements identical to those in FIG. 1 carry the same reference numerals. The amplifier 1 comprises a current mirror and a voltage follower stage. The current mirror is formed by the P-channel MOS transistors 11 and 12, connected to the positive supply terminal $V_{DD}$. The drain of transistor 11 is connected to the branch 9 and to the gates of transistors 11 and 12. The drain of transistor 12 is connected to the branch 8 and to the gate of the N-channel MOS transistor 13, connected as a voltage follower stage between the supply terminal $V_{DD}$. The drain of transistor 12 is connected to the branch 8 and to the gate of the N-channel MOS transistor 13, connected as a voltage follower stage between the supply terminal $V_{DD}$ and the terminal 5. The transistors T1 and T2 are identical and the current mirror is of the ratio K1, so that the currents passing through the transistors T1 and T2 are in the same ratio. The conductor block 4 consists of a compatible bipolar transistor 41, whose emitter is connected to the terminal 7 and whose base and collector are connected to the common point 6 of the base of T2 and the resistor 3. To ensure the inequality I3>I1, it is important for the transistor 41 to be so proportioned that its effective emitter surface is considerably greater than that of the transistor T1.

Figure 4:
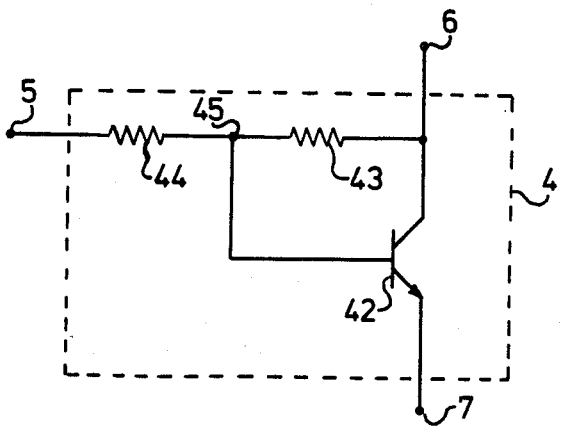
FIG. 4 is an alternative embodiment of the amplifier of FIG. 1.

This disadvantage can be eliminated if the base of the transistor 41 is supplied from a point presenting a higher voltage. Such is the case with the circuit shown in FIG. 4, in which the base of the compatible bipolar transistor 42 is connected to the terminal 5 through resistor 44 and to the point 6 through resistor 43. The inequality I3 >I1 will be satisfied if the ratio of the resistor 43 to the resistor 44 is greater than that of the resistor 3 to the resistor 2, even if the transistor 42 is identical to the transistor T1.

Figure 5:
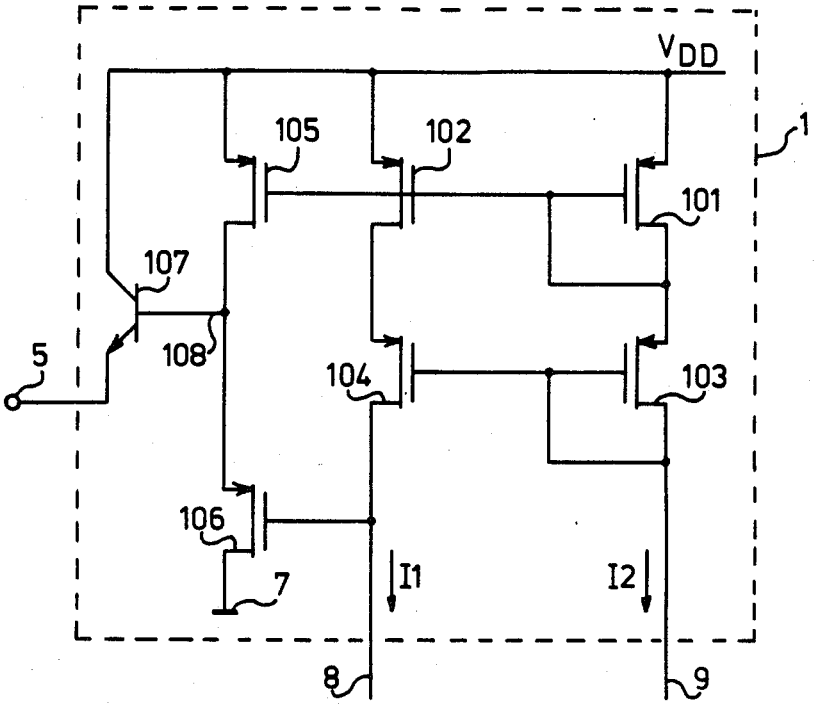
FIG. 5 is another embodiment of the amplifier of FIG. 1.

Another embodiment of the transresistance amplifier 1 is shown in FIG. 5. A current mirror, formed by the P-channel MOS transistors 101 and 102 on the one hand and 103 and 104 on the other, is connected in series between the positive supply terminal $V_{DD}$ and the branches 8 and 9. The two transistors 101 and 103 are connected as diodes and all the transistors 101 to 104 present a ratio K1. The P-channel transistors 105 and 106 form a voltage follower stage. The transistor 105 has its gate connected to the gates of transistors 101 and 102, its source connected to the terminal $V_{DD}$ and its drain connected to the source of the transistor 106, whose gate is connected to the drain of transistor 104 and whose drain is connected to the circuit's negative supply terminal 7. The point 108, common to the drain of the transistor 105 and the source of the transistor 106, is connected to the base of a compatible bipolar transistor 107 whose collector is connected to the terminal $V_{DD}$ and whose emitter is connected to terminal 5. The connection of the four transistors 101 to 104 allows a reduction in the effects of a variation in supply voltage on the value of the ratio of the currents I1 and I2, and therefore on the precision of the reference voltage $V_{ref}$. Furthermore, the output transistor 13 of the circuit in FIG. 3 is replaced in FIG. 5 by a compatible bipolar transistor 107 connected to a follower stage formed by the transistors 105 and 106. This arrangement of the transistors 105 to 107 allows a reduction in the circuit's output resistance and this improves the supplying of neighbouring circuits from the reference voltage circuits.

Figure 6:
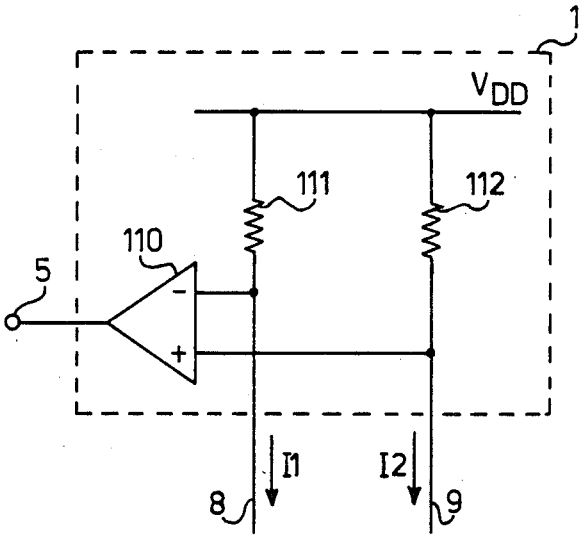
FIG. 6 is a further embodiment of the amplifier of FIG. 1.

FIG. 6 shows a further embodiment of the amplifier 1. Two resistors 111 and 112, through which the currents 11 and 12 pass, create a voltage difference which is applied to the input of an operational amplifier 110. The output of the amplifier 110 is connected to the terminal 5. If R1 and R2 are the values of the resistors 111 and 112 respectively, an effort will be made to satisfy the equation: $R1 \cdot I1=K1 \cdot R2 \cdot I2>V_{OS}$, in order to render negligible the effects of the input offset voltage ($V_{OS}$) of the amplifier 110. A layout such as the one in FIG. 6 is known and can, for example, be found in the article by Carl R. Palmer et al entitled "A curvature corrected micropower voltage reference," which appears in the IEEE International Solid-State Circuits Conference of 1981.

Figure 7:
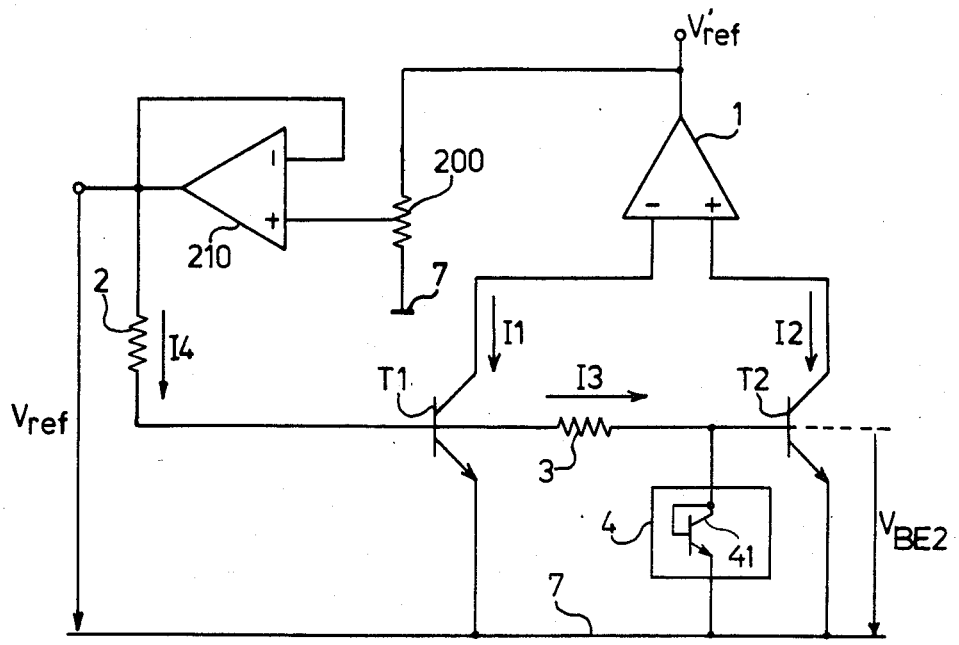
FIG. 7 shows a variant of the circuit according to the invention.

The reference voltage $V_{ref}$ delivered by the preceding circuits is well-defined and approaching 1.2 volts. It is sometimes desirable to have at one's disposal a reference voltage higher than this value. The circuit in FIG. 7 shows how to obtain a voltage higher than the voltage $V_{ref}$ from the circuit according to the invention without damaging its performance. The elements identical to those in FIG. 1 bear the same reference numerals. The output of the transresistance amplifier 1 is connected to a voltage divider 200 whose output is applied via a voltage follower stage 210 to the resistor 2. The voltage divider 200 may be a potentiometer delivering a fraction of the output voltage of the amplifier 1. The output voltage of the follower stage 210 is always equal to $V_{ref}$, while the output voltage of the amplifier 1 is: $V_{ref}' = -V_{ref}/\alpha$.

Figure 8:
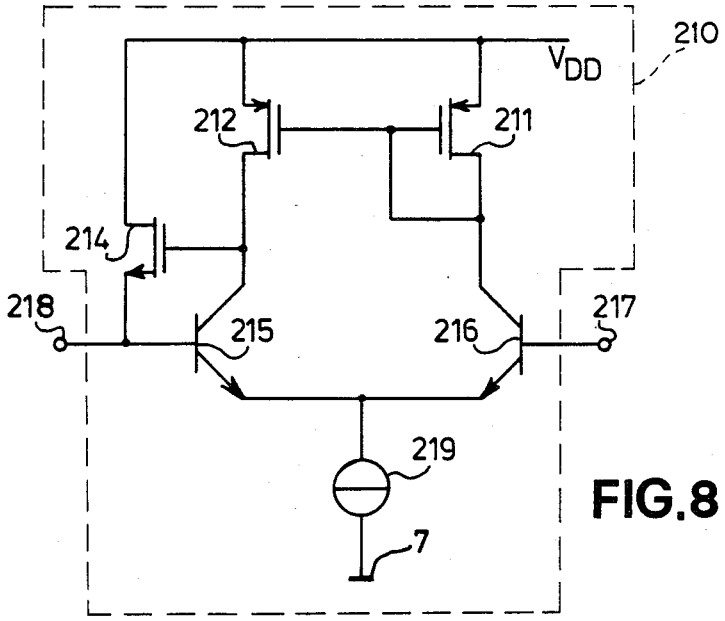
FIG. 8 is an embodiment of the amplifier-follower of FIG. 7.

The voltage follower stage 210 must present as low an offset voltage as possible and preferably one which is proportional to the absolute temperature. An embodiment of this follower stage, based on the use of compatible bipolar transistors, is shown in FIG. 8. It comprises a differential pair of compatible bipolar transistors 215 and 216 whose bases are connected, respectively, to the non-inverting input terminal 217 and the inverting input terminal 218, whose emitters are connected to a current source 219 and whose collectors are connected respectively to the drains of the MOS transistors 212 and 211, which are connected as a current mirror. The circuit also comprises MOS transistor 214, whose gate is connected to the common point of the drain of transistor 212 and the collector of transistor 215, whose drain is connected to the supply terminal $V_{DD}$ and whose source is connected to the base of transistor 215.

Although the present invention has been described in the context of particular embodiments, it is clear that it is open to modifications or variations without falling outside its scope. In particular, if the circuit according to the invention allows the linear term of the reference voltage variation curve to be compensated according to the temperature, the quadratic term can be compensated by means of a known circuit called a "curvature correction circuit."

What is claimed is:

1. A reference voltage source in MOS technology, comprising:

a first compatible bipolar transistor;

a second compatible bipolar transistor having an emitter connected to an emitter of said first compatible bipolar transistor:

a first means for ensuring a lower current density through said second compatible bipolar transistor than that passing through said first compatible bipolar transistor;

a transresistance amplifier having two inputs connected respectively to the collectors of the first and second compatible bipolar transistors and having an output connected to an output terminal delivering said reference voltage and connected to the base of said first compatible bipolar transistor via a first resistor;

a second resistor connected between the bases of said first and second compatible bipolar transistors; and a second means connected between the base of the said second compatible bipolar transistor and the common point of the emitters of said first and second compatible bipolar transistors, for drawing through said first and second resistors a current of a higher value than that of the current passing through said first compatible bipolar transistor.

2. A reference voltage source according to claim 1, wherein the said second means for drawing a current comprises a third compatible bipolar transistor.

3. A reference voltage source according to claim 2, wherein said third compatible bipolar transistor comprise an emitter connected to said common point of the emitters of the first and second compatible bipolar transistors, and a base connected to its collector and connected to the base of said second compatible bipolar transistor.

4. A reference voltage source according to claim 2, wherein said third compatible bipolar transistor comprises an emitter connected to said common point of the emitters of said first and second compatible bipolar transistors, a collector connected to the base of said second compatible bipolar transistor and having a base connected to its collector via a third resistor and connected to said output terminal via a fourth resistor.

5. A reference voltage source according to claim 1, wherein said transresistance amplifier comprises a current mirror and a voltage follower stage which is connected between said current mirror and said output terminal and wherein said current mirror and said first and second compatible bipolar transistors are so proportioned that the current density passing through said second compatible bipolar transistor is lower than that passing through said first compatible bipolar transistor.

6. A reference voltage source according to claim 1, wherein said transresistance amplifier comprises third and fourth resistors connectable respectively, between a terminal of a supply voltage source and the collectors of said first and second compatible bipolar transistors, and an operational amplifier having inputs connected respectively to said collectors of the first and second compatible bipolar transistors and having an output connected to said output terminal.

7. A reference voltage source according to claim 1, further comprising a voltage divider stage connected between the output of said transresistance amplifier and said first resistor.

8. A reference voltage source according to claim 1, further comprising a voltage divider stage connected in series with a voltage follower stage, said voltage divider and follower stages being connected between the output of the said transresistance amplifier and said first resistor.

9. A reference voltage source according to claim 8, wherein said voltage follower stage comprises at least one differential pair of compatible bipolar transistors.

* * * * *